United States Patent [19]

Cherednichenko et al.

[11] 3,948,495

[45] Apr. 6, 1976

[54] APPARATUS FOR CONTINUOUS VACUUM-REFINING OF METALS

[76] Inventors: Vladimir Semenovich Cherednichenko, ulitsa Zorge, 269, kv. 79; Gennady Ivanovich Orlov, ulitsa Vatutina, 27, kv. 20; Jury Anatolievich Naryshkin, ulitsa Bljukhera, 7, kv. 55, all of Novosibirsk, U.S.S.R.

[22] Filed: July 14, 1975

[21] Appl. No.: 595,683

[52] U.S. Cl. ..... 266/16; 266/34 V; 13/8; 13/31; 75/63; 75/85

[51] Int. Cl.[2] ..... C22B 25/06

[58] Field of Search ..... 75/63, 64, 49, 85; 266/16, 266/34 V, 17; 13/8, 31

[56] References Cited

UNITED STATES PATENTS 3,803,335 4/1975 Esjutin et al. ..... 13/31

FOREIGN PATENTS OR APPLICATIONS 1,159,918 7/1969 United Kingdom ..... 75/63

*Primary Examiner*—Gerald A. Dost

*Attorney, Agent, or Firm*—Haseltine, Lake & Waters

[57] ABSTRACT

The present invention relates to apparatus for continuous purifying of tin from impurities — lead and bismuth, by refining.

The apparatus comprises a vacuum chamber accommodating a range of trays arranged in succession and fitted each with an overflow conduit disposed in its side wall at a certain distance from its upper end face, with the overflow conduit communicating with the tray space and being positioned parallel to the tray axis and with the overflow conduit outlet being connected to the underlying tray and a tray column being encompassed with an induction coil establishing a magnetic field under whose effect the metal rotates climbing to the level of the overflow conduit.

2 Claims, 2 Drawing Figures

APPARATUS FOR CONTINUOUS VACUUM-REFINING OF METALS

The present invention relates to metal processing equipment and more particularly to apparatus for continuous vacuum-refining of metals.

The invention may prove to be most advantageous in producing tin with a minimum lead and bismuth content.

The now-existing apparatus for continuous vacuum-refining of metals comprises a cylindrical vacuum chamber accommodating a range of graphite trays arranged in succession one above another in a vertical plane, adapted to receive preliminary melted impure metal and forming a column, and an induction heater encompassing the graphite tray column and provided with a current lead to feed electric energy thereto. The induction heater warms up the metal accommodated in the trays to a volatilization temperature of low-boiling impurities and evaporates them. Each tray has in its bottom an internal cylindrical collar with a central hole into which a tapered branch pipe is introduced.

In this case the collar central holes and tapered branch pipes are aligned axially.

The internal cylindrical collar precludes the draining of metal being refined through its central hole. The collar height is so selected that a clearance for the passage of impurity vapors, referred to hereinafter as volatilized impurities, is formed between the bottom of the overlying tray and the collar end face.

The coaxial central holes of all the trays and tapered branch pipes form a vapor pipe for removing volatilized impurities. The length of the tapered branch pipe would be such that its lower end face would be spaced at a minimum distance from the central hole of the underlying tray. This would rule out the ingress of the volatilized impurities from the underlying tray into the space of the overlying tray and would provide for the ejection of vapors from the underlying trays.

In the zone of molten metal the bottom of each tray has an outlet ensuring a gradual overflow of the molten metal from the overlying into the underlying tray. The lower tray communicates via a pipeline with a cooler located outside the vacuum chamber. The refined metal flows from the lower tray into the cooler, where the metal temperature decreases and the metal is drained into a receiving tank.

A disadvantage of this present-art apparatus resides in a small open metal surface in the tray, the area of this surface determining the intensity of impurity evaporation. As it is known, dipped impurities are not able to volatilize and can reach the metal surface only due to diffusion. The process of transfer of such dipped impurities to the metal surface can be intensified by stirring. However, the known apparatus are not provided with such stirring means. This disadvantage can be partly offset by increasing the number of trays. But it will lead to a considerable increase in the overall dimensions of the apparatus.

Moreover, the now-existing apparatus suffers from another disadvantage which lies in the arrangement of the metal overflow conduit in the tray bottom. With the above arrangement the batches of metal, that have not yet been subjected to refining, can overflow through this outlet in the next tray, diminishing thereby the degree of metal refining.

The principal object of the invention is the provision of an apparatus for continuous refining of metals, wherein, owing to a modified design of trays and the use of means increasing an open metal surface, the apparatus output and the degree of purifying the metal from impurities by refining are enhanced and overall dimensions of the apparatus are reduced.

Said object is achieved by providing an apparatus for continuous refining of metal, comprising a cylindrical vacuum chamber accommodating a range of trays with central holes arranged in succession one above another in a vertical plane, forming a column and adapted to receive preliminary melted impure metal, and a heater encompassing the column and provided with a current lead to feed electric energy thereto for heating the metal accommodated in the trays and evaporating low-boiling impurities therefrom, with the volatilized impurities being removed via a vapor pipe formed by said tray holes into a condenser disposed in the vacuum chamber under the tray column, wherein, according tto the invention, each tray is fitted with an overflow conduit located in its side wall at a certain distance from its upper end face, said overflow conduit communicating with the tray space and being disposed parallel to the tray axis, with the overflow conduit outlet being in communication with the underlying tray, and the tray column is encompassed by an induction coil establishing a magnetic field under whose effect the molten metal accommodated in the tray rotates climbing to the level of the overflow conduit, with the overflow conduit outlet of the lower tray communicating with a refined metal cooler set up under the vacuum chamber.

Owing to the magnetic field established by the coil the metal being refined commences to rotate intensively and is intermixed. Centrifugal forces urge the spinning metal to climb along the vertical tray wall with the open metal surface being substantially enlarged as a result. Hence, the surface from which volatilization of impurities occurs is considerably increased. Owing to an intense stirring the dipped batches of metal comprising a larger amount of impurities, as compared with the metal disposed on the open surface, move to the volatilization surface.

This intensifies substantially the metal refining rate.

Since the rotating open surface of the metal assumes the shape of a heavily concaved meniscus, the thickness of metal in the upper part of the meniscus is rather small, with the degree of metal refining in this zone being a maximum one for a given tray, and as the overflow conduit is located in the upper part of the meniscus, the metal drained from that tray will feature a highest refining degree.

Thus, metal spinning ensures a higher rate and a maximum degree of removing impurities from a single tray, this resulting in a higher output of the apparatus and in a better refining degree. The higher degree of refining achievable owing to intense rotation, which contributes to a substantial increase in the open metal surface, does not call for a larger number of trays, the apparatus enabling the above outlined effect to be obtained with a minimum number of the trays. This diminishes the overall dimensions of the apparatus as a whole.

The nature of the invention will be clear from the following detailed description of the particular embodiment of an apparatus for purifying tin from lead and bismuth by refining, to be had in conjunction with the accompanying drawings, in which.

Figure 1:
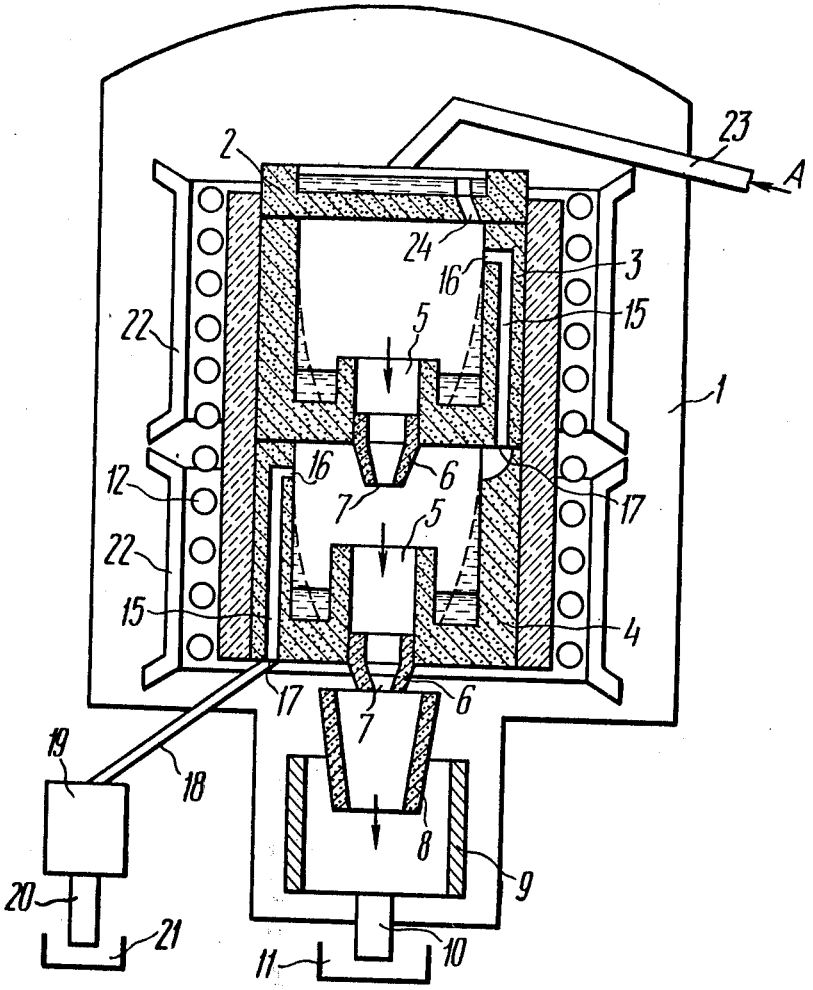
FIG. 1 is a longitudinal sectional view of an apparatus for continuous refining of metal, according to the invention.

An apparatus for continuous vacuum-refining of tin comprises a cylindrical vacuum chamber 1 (FIG. 1).

The chamber 1 accommodates a range of trays disposed in succession in a vertical plane, with the tray 2 being adapted to receive preliminary melted impure metal and trays 3 and 4 — to refine tin. The tin supply into the tray 2 is shown in the drawing by arrow A.

The trays 3 and 4 in their bottoms have central holes 5 into which tapered branch pipes 6 are introduced. The holes 5 and branch pipes 6 are aligned axially and form a vapor pipe for removing low-boiling impurities liberated during the tin refining process. The length of the tapered branch pipe 6 in the tray 3 would be such that their lower end face 7 would be spaced at a minimum distance from the central hole 5 of the tray 4. This would preclude the ingress of volatilized impurities from the tray 4 into the space of the tray 3 and would provide for vapor ejection. The branch pipe 6 of the tray 4 is connected to a condenser 9 through an additional branch pipe 8. In the condenser 9 the volatilized impurities are condensed and cooled to a temperature of 400°C, whereupon they flow (in a fluid state) along a pipeline 10 into a condensate tank 11.

The trays 2, 3 and 4 form in conjunction a column encompassed by a heater 12 which is an inductor. The inductor has a current lead to feed electric energy needed for heating the trays 2, 3 and 4 together with the tin accommodated therein to an impurity volatilization temperature. The volatilizing impurities are removed, as it has been stated above, via a vapor pipe.

Figure 2:
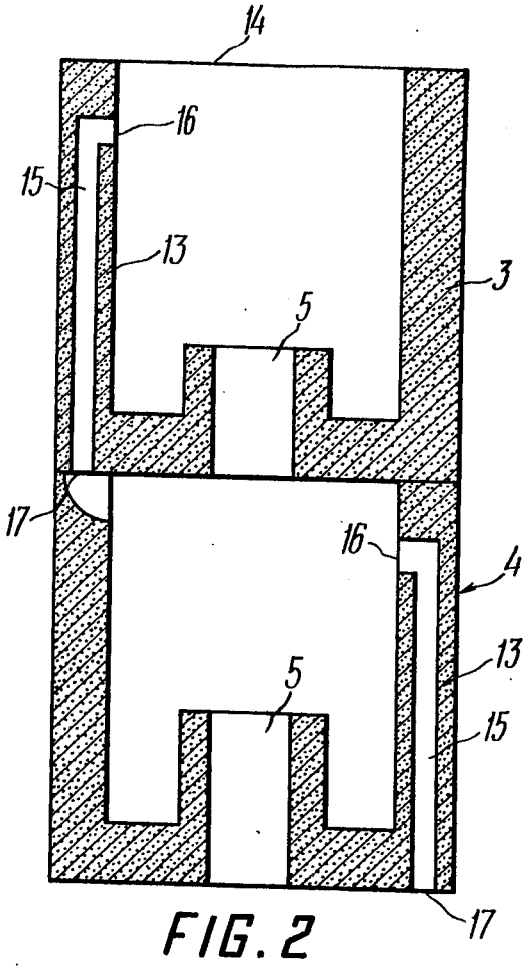
FIG. 2 is a longitudinal sectional view (scaled up) of trays shown in FIG. 1.

Each of the trays 3 and 4 (FIG. 2) has an overflow conduit 15 located in a tray side wall 13 at a certain distance from its end face 14, with the inlet 16 of the overflow conduit 15 communicating with a space of the corresponding tray.

The overflow conduit 15 is disposed parallel to the tray axis and the outlet 17 of this conduit 15 communicates with the underlying tray 4. The outlet 17 of the overflow conduit 15 of the tray 4 is connected via a pipeline 18 (FIG. 1) to a refined tin cooler 19 disposed outside the vacuum chamber 1. Upon cooling, the refined tin runs off along a pipeline 20 from the cooler 19 into a refined tin tank 21.

The heater 12 is encompassed from the outside by an induction coil 22 establishing a magnetic field. Under the effect of this field the metal accommodated in the trays 3 and 4 rotates climbing to the inlet 16 of the overflow conduit 15 in the side wall 13 of the trays 3 and 4.

The herein-proposed apparatus functions as follows.

Preliminary melted impure tin is supplied into the intake tray 2 along a pipeline 23 in the direction shown by arrow A. Passing through a bottom hole 24 in this tray 2 the tin overflows into the upper tray 3 where it is heated to an impurity volatilization temperature owing to the energy generated by the heater 12. The induction coil 22 brings the molten metal contained in the trays 3 and 4 into rotation. Stirring and a larger volatilization surface result in an intense evolution of volatilized impurities from the metal, with these volatilized impurities being passed via the vapor pipe into the condenser 9 where they are condensed, cooled and discharged along the pipeline 10 into the condensate tank 11. The metal revolving in the trays assumes the shape of a meniscus, reaches the inlet 16 of the overflow conduit 15 and gets into the space of the tray 4.

In the tray 4 the tin is refined by a still higher degree, and then the refined tin flows through the overflow conduit 15 of the tray 4 into the pipeline 18. Upon passing via the pipeline 18, it runs off into the cooler 19 and then to the refined tin tank 21.

The tin and condensate from the tanks 11 and 21 are cast into pigs.

What we claim is:

1. An apparatus for continuous vacuum-refining of metal, comprising a cylindrical vacuum chamber; a range of trays, having each a central hole and side walls, said trays being accommodated in said vacuum chamber, disposed in succession one above another in a vertical plane, forming a column and adapted to receive preliminary melted impure metal; a vapor pipe formed by the holes of said trays; a heater set up inside said vacuum chamber, encompassing the column of said trays and provided with a current lead to feed electric energy thereto for heating the metal accommodated in the trays and evaporating low-boiling impurities therefrom, said impurities being removed along said vapor pipe; a condenser located under the column of said trays and adapted to receive the impurities emerging from said vapor pipe; each of said trays has an overflow conduit located in its side wall at a certain distance from its upper end face, said overflow conduit communicating with the tray space, being positioned parallel to the tray axis, with the outlet of this overflow conduit being in communication with the underlying tray; an induction coil encompassing the column of said trays and establishing a magnetic field under whose effect the molten metal accommodated in the tray rotates climbing to the level of said overflow conduit; a cooler set up under said vacuum chamber and communicating with said outlet of said overflow conduit of the lower tray to supply metal therein.

2. An apparatus of claim 1, wherein said induction coil is disposed outside the heater and encompasses it.

* * * * *